United States Patent [19]

Eckerdt

[11] 4,137,740

[45] * Feb. 6, 1979

[54] KEY MOUNT

[76] Inventor: George H. Eckerdt, 948 Culver Rd., Rochester, N.Y. 14609

[ * ] Notice: The portion of the term of this patent subsequent to Feb. 7, 1995, has been disclaimed.

[21] Appl. No.: 842,789

[22] Filed: Oct. 17, 1977

Related U.S. Application Data

[63] Continuation-in-part of Ser. No. 690,983, May 26, 1976, Pat. No. 4,072,033.

[51] Int. Cl.[2] ..... A47G 29/10

[52] U.S. Cl. ..... 70/45 CR

[58] Field of Search ..... 70/456–459; 24/3 K; 150/40; 248/205 A

[56] References Cited

U.S. PATENT DOCUMENTS

| | | | |
|---|---|---|---|
| 3,415,300 | 12/1968 | Worcester | 150/40 |
| 3,683,911 | 8/1972 | McCormick | 248/205 A |
| 4,072,033 | 2/1978 | Eckerdt | 70/456 B |

*Primary Examiner*—Robert L. Wolfe

*Attorney, Agent, or Firm*—Stonebraker, Shepard & Stephens

[57] ABSTRACT

A mount for several keys is secured in a convenient place to support the keys in a row dependent from tags that identify the keys. A support strip long enough to mount all the keys has the hook part of a two-part hook-and-loop pile fastener on a front face and a pressure-sensitive adhesive layer on a rear face, with a manually removable release sheet covering the adhesive layer. The key tags are each cut from resin material joined to the loop part of the two-part hook-and-loop fastener so that the loop part is arranged on a rear face of each of the key tags, and the front faces of the key tags have a front surface suitable for indicia to identify the keys. Each of the key tags has a die-cut hole near an edge and a key ring in the hole to support keys connectable to the rings to be dependent from the tags. The tags are releasably attachable to the support strip to mount the keys in a way that makes the front surfaces of the tags visible, and the keys are usable while connected to the tags.

4 Claims, 2 Drawing Figures

KEY MOUNT

RELATED APPLICATIONS

This application is a continuation-in-part of my copending application Ser. No. 690,983, filed 26 May 1976, and now U.S. Pat. No. 4,072,033 and entitled KEY HOLDER.

BACKGROUND OF THE INVENTION

There have been many suggestions for mounting keys in some arrangement that makes then identifiable and accessible, and people have long recognized that a convenient and orderly arrangement of keys in an accessible mount is desirable. The art of mounting keys for ready and convenient use is relatively unsophisticated, however, and many problems remain relative to expense, ease of installation and use, convenience, and marketability, so that there remains an unmet need for a simple, convenient, and otherwise satisfactory key mount.

The invention involves recognition and study of the problems of economically mounting keys for convenient use and proposes a key mount that meets many of these needs. The invention aims at a combination of low-cost, practical marketability, ease of manufacture, assembly and packaging, and simplicity and convenience in both installation and use.

SUMMARY OF THE INVENTION

The inventive key mount includes a support strip formed of a resin material and made long enough to mount a plurality of keys. The support strip has the hook part of a two-part hook-and-loop pile fastener arranged on its front face, and a pressure-sensitive adhesive layer on its rear face for adhesively securing the support strip on a key mount surface. A manually removable release sheet covers the adhesive layer. A plurality of key tags are each cut from resin material joined to the loop part of the two-part hook-and-loop fastener so that the loop part is arranged on a rear face of each of the key tags and the front face of each of the key tags has a smooth surface suitable for bearing indicia relative to a key associated with each tag. The tags have die-cut holes in the region of an edge of each of the tags, and a key ring is arranged in each of the holes to support a key connectable to the ring to be dependent from the key tag. The key tags are releasably attachable to the support strip along the length of the support strip for mounting the keys in a way that makes the front faces of the key tags visible. The device also accommodates special tags made for promotional purposes, and the keys are conveniently usable while attached to the key tags.

DRAWINGS

FIG. 1 is a fragmentary, front elevational view of a preferred embodiment of the inventive key mount; and FIG. 2 is a cross-sectional view of the mount of FIG. 1 taken along the line 2—2 thereof.

DETAILED DESCRIPTION

Figure 1:
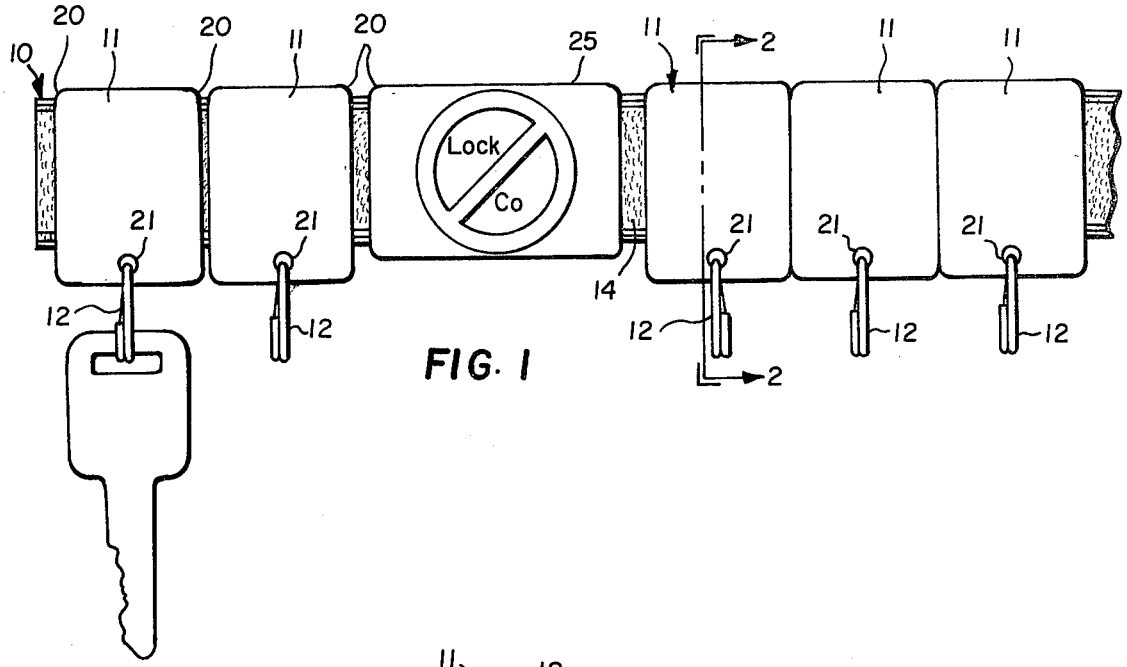

The inventive key mount includes a support strip 10 that can be adhesively secured to any convenient surface, and a plurality of key tags 11 that are easily mounted on and detached from strip 10, and that each carry rings 12 to support keys. The structure required involves optimum simplicity, economy, and convenience as explained below.

Strip 10 is formed of a resilient material preferably in the form of a woven fabric base 13 that is generally flat, but also flexible. This allows strip 10 to conform to an irregular or curved surface and makes strip 10 mountable on practically any surface where a user desires to hang keys. The front face of fabric base 13 is formed with an array of resilient hooks 14 preferably formed of mono-filament resin material to form the hook part of a two-part hook-and-loop pile fastener. Fabric base 13 can be secured to an extruded resin strip or other backing or support material, if desired, although this is ordinarily not necessary. The rear face of backing 13 opposite the array of hooks 14 is covered with a layer 15 of pressure-sensitive adhesive that supports strip 10 on a key mount surface. A release sheet 16 covers adhesive layer 15 and is manually removable for securing strip 10 in place.

Tags 11 preferably include a fabric base 17 that is woven to provide an array of loops 18 extending outward from fabric 17 to form the loop part of a two-part hook-and-loop fastener. Loops 18 are releasably attachable to hooks 14 in a generally known way so that tags 11 are releasably attachable to strip 10 simply by pressing loops 18 against hooks 14. Although the hook-and-loop portions of strip 10 and tags 11 can be interchanged, loops 18 on tags 11 are preferred, because they are less likely to catch on fabric and other objects as keys are used while connected to tags 11. Fabric base 17 is preferably secured to resin material 19 so that loops 18 extend from a rear face of tag 11 and resin material 19 has a front face with a smooth surface.

Figure 2:
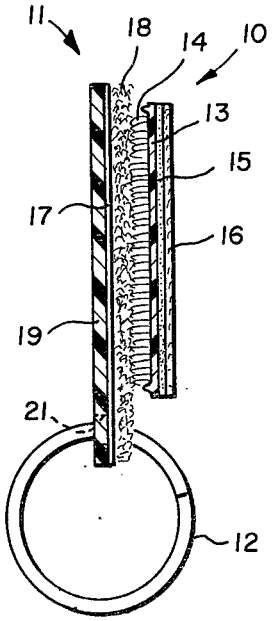

A convenient way of making tags 11 is to extrude a resin strip having a cross-sectional configuration of resin material 19 as shown in FIG. 2, and continuously bond a length of fabric strip 17 to the rear face of strip 19. Then tags 11 are preferably die cut from a long strip with a die that forms each tag 11 with rounded corners 20 and a die-cut hole 21 near an edge of tag 11. Loops 18 in fabric backing 17 then extend from edge to edge of each tag 11, and tags 11 are made ready for supporting keys by merely attaching key rings 12 in holes 21. Tags 11 are preferably cut to be longer from top to bottom than the vertical height or width of strip 10 so as to be attachable to the full width of strip 10 and still leave clearance room for rings 12 below the bottom edge of strip 10. Tags 11 can also be made in many different sizes and shapes and can be made of different-colored resin materials, and strips suitable for cutting tags 11 can be purchased with fabric 17 and loops 18 attached.

Strip 10 is preferably formed of a suitable length to support a desired number of tags 11, and tags 11, with attached key rings 12, are preferably secured to strip 10 to make a compact package for marketing. The front faces of resin pieces 19 of tags 11 provide a smooth surface for indicia identifying keys attached to a particular tag, and this can be written directly on tags 11 as shown in FIG. 1, or can be written on paper or plastic stickers that are attached to the front faces of tags 11. The package prepared for marketing can include stickers for identifying keys on each of the tags 11. The user removes release sheet 16, secures strip 10 to a convenient key-mounting surface, attaches keys to rings 12, and identifies each tag 11 by directly marking on tags 11 or attaching identification labels, and the inventive key mount is ready for use. A key can be taken from the mount by merely pulling tag 11 away from strip 10 and can be remounted by merely pressing tag 11 against strip 10. Tags 11 can be mounted in any desired order along strip 10, and the attachment of tags 11 to the keys does not impair or encumber the using and carrying of keys removed from strip 10.

Another feature of the invention is its capacity for use as a promotional device by including a special tag 25 bearing a trademark, logo, or advertising message or symbol, such as schematically illustrated in FIG. 1. Promotional tag 25 can have many different shapes and can be formed in many ways to present the desired message, including molding, embossing, attaching a separate message label, etc. Message tag 25 can also have a hole for a key ring and can be attached to keys in the same way as tags 11. The rear face of message tag 25 is preferably provided with loops 18 just as tags 11 for securing to strip 10 in the same releasable way.

The drawings illustrate a very simple preferred embodiment of the invention, and many embellishments can be added. Some of these have been mentioned above, and others will be apparent to those skilled in the art as the invention is applied to different circumstances.

What is claimed is:

1. A key mount comprising:

a. a support strip formed of a resin material and having a predetermined length long enough to mount a plurality of keys;

b. said support strip having the hook part of a two-part hook-and-loop pile fastener arranged on a front face of said support strip;

c. a pressure-sensitive adhesive layer on a rear face of said support strp for adhesively securing said support strip on a key mount surface;

d. a manually removable release sheet covering said adhesive layer;

e. a plurality of key tags, each cut from resin material joined to the loop part of said two-part hook-and-loop fastener so that said loop part is arranged on a rear face of each of said key tags;

f. a front face of each of said key tags having a smooth surface suitable for bearing indicia relative to a key associated with each of said key tags;

g. each of said key tags having a die-cut hole in the region of an edge of each of said key tags;

h. a key ring in each of said die-cut holes of said key tags to support a key connectable to said ring to be dependent from said key tag; and i. said plurality of key tags being releasably attachable to said support strip along the length of said support strip for mounting a plurality of keys and making said front faces of said key tags visible.

2. The key mount of claim 1 wherein said support strip is formed as a fabric strip.

3. The key mount of claim 1 including a message tag bearing a message on a front face and bearing said loop part of said two-part hook-and-loop fastener on a rear face so that said message tag is releasably securable to said support strip.

4. The key mount of claim 3 wherein said support strip is formed as a fabric strip.

* * * * *